United States Patent [19]

Kemper

[11] 3,951,796

[45] Apr. 20, 1976

[54] OIL RECIRCULATING TOILETS

[75] Inventor: James M. Kemper, Sherman Oaks, Calif.

[73] Assignee: Monogram Industries, Inc., Santa Monica, Calif.

[22] Filed: May 5, 1975

[21] Appl. No.: 574,354

[52] U.S. Cl. ..... 210/62; 4/DIG. 11; 4/10

[51] Int. Cl.[2] ..... C02B 1/36

[58] Field of Search ..... 210/62; 4/10, DIG. 11

[56] References Cited

UNITED STATES PATENTS

| | | | |
|---|---|---|---|
| 3,673,614 | 7/1972 | Claunch | 4/DIG. 11 |
| 3,791,866 | 2/1974 | Kunin | 210/63 |
| 3,807,947 | 4/1974 | Lasas | 210/62 |
| 3,829,909 | 8/1974 | Rod | 4/DIG. 11 |
| 3,899,425 | 8/1975 | Lewis | 210/62 |

*Primary Examiner*—Robert I. Smith

*Attorney, Agent, or Firm*—Poms, Smith, Lande & Glenny

[57] ABSTRACT

A method for preventing a flushing oil used in recirculating toilets from turning yellow and having an offensive odor when contacted with animal waste products containing, among other things, water, carotene, bilirubin, oil soluble unsaturated fats, ammonia, amines and amides such as urea which includes the steps of mixing with said waste products a water-soluble compound having an active chlorine atom whereby said water-soluble chlorine compound is dissolved in the water contained in said waste products and reacts with the ammonia, amines and/or amides to form an oil soluble N-chloro-amine or amine (particularly $NCl_3$) which is the reaction product of said ammonia, amide or amine contained in said waste product and the chloro containing compound, said chloro-amide or amine being soluble in said flushing oil, and contacting said flushing oil with said N-chloro-amide or amine thereby dissolving said chloro-amide or amine in said flushing oil to contact said oil soluble unsaturated fats, carotene and bilirubin and preventing said oil from turning yellow.

8 Claims, No Drawings

OIL RECIRCULATING TOILETS

BACKGROUND OF THE INVENTION

The use of vehicles for recreation purposes such as boats, campers and trailers as well as public transportation vehicles such as airplanes, buses and even trains have increased greatly in recent times which in turn has compounded the problem of disposing of human waste created by the people using these vehicles.

Initially some of these vehicles (e.g. boats and trains) disposed of the human waste directly into our environment which, of course, has a tendency to pollute the environment because of the raw sewage disposed therein. Other vehicles (e.g. buses, planes and campers) used holding tanks contained in the vehicles whereby water was used to flush the raw sewage from the toilets and the water and raw sewage disposed of in an appropriate manner as for example dumped into a sewage system. These holding tanks were impractical because they had to be of a relatively large size in order to accommodate the water used for flushing as well as the sewage. Additionally, because the vehicle needed to carry a large amount of water to be used as the flushing fluid this greatly increased the weight. Both defects (i.e. the size and the weight) are of significant disadvantage in, for example, airplanes because of the weight and space involved and in boats, campers and trailers because of the amount of space necessary to accommodate such holding tanks.

In view of the enumereated disadvantages in the prior art sewage disposal systems, most recreational and public vehicles such as boats, planes, trains, buses, etc. are now fitted with so-called recirculating toilets. A recirculating toilet is one which uses a recirculating liquid as a flushing fluid for conveying the human waste from the toilet to a separating tank where the flushing fluid and human waste products are separated. Thereafter, the flushing fluid is recirculated to be used again as the flushing medium. As is apparent, since the flushing liquid is being utilized over and over again only a small amount of liquid is necessary to accomplish its intended purpose (i.e. removing human solid and liquid wastes) thereby enabling a great saving of weight and space which is advantageous in both recreational and public vehicles.

In addition to being used in vehicles, it has been proposed to use recirculating toilets in homes, etc. in order to conserve water and to drastically reduce or eliminate the need for complex and costly centralized sewage treatment plants.

It is now the accepted practice in recirculating toilets, regardless of where they are used, to utilize, as the flushing medium, an oil which is immiscible with liquid human waste (i.e. water). This allows the recirculating fluid or liquid to be separated in, for example, a separating tank, not only from the solid waste material but also from the liquid waste material (e.g. urine).

Even though water immiscible oils have been successfully used as flushing fluids in recirculating toilets, the water immiscible oils possess one distinct disadvantage; the flushing oil gradually acquires a yellow color after being contacted with human waste products. Most people find the yellow color extremely objectionable. Therefore, many flushing fluids have added thereto a coloring agent such as a blue dye which is supposed to mask the yellow color. However, we have found that after very few flushings the flushing fluid still turns yellow even in the presence of color masking agents such as the blue dye mentioned above.

It is thus a desideratum in the art to provide a method and a means for preventing an oil utilized in recirculating toilets from turning yellow for a long period of time by inexpensive and safe methods. However, even though many attempts have been made heretofore, no such system, insofar as we are aware, has been developed.

SUMMARY OF THE INVENTION

In view of the foregoing, it is a primary object of the present invention to disclose a method for controlling and preventing a flushing oil used in recirculating toilets from becoming an undesirable yellow color when contacted by human waste.

Another object of the present invention is to embody and disclose a method for making a recirculating toilet attractive by providing a flushing liquid which is immiscible in water and is substantially saturated and, additionally, an inexpensive compound which prevents such an oil from becoming yellow when contacted with human waste.

Another and further object of the present invention is to prevent a flushing oil from turning yellow because of unsaturated fats, carotene, and bilirubin dissolved therein, said unsaturated fats having been initially part of the waste products of humans deposited in said oil.

Still another object of the present invention is to oxidize unsaturated fats, carotene and bilirubin dissolved in a flushing oil by forming in situ N-chloro-amide or amine which are oil soluble and oxidizing agents for said unsaturated fats, carotene and bilirubin.

Other objects of the present invention will be apparent from the following detailed description which is for the purpose of illustration only and is not to be considered as limiting the invention.

DESCRIPTION OF THE PREFERRED EMBODIMENT

The present invention is predicated in part on the discovery that the reason the flushing oil turns yellow when contacted with animal waste products is because the waste products contain, inter alia, oil soluble unsaturated fats, carotene and bilirubin. These oil soluble yellow compounds, we have found, can be oxidized yy an N-chloro-amide or amine which are formed in situ by adding to the recirculating toilet a water-soluble chlorine compound having an active chlorine atom. By the phrase "water-soluble chlorine compound having an active chlorine atom" we mean a compound containing chlorine which, when brought in contact with ammonia, amide or amine contained or formed by the human waste product, will react with the ammonia, amine or amide by replacing one or more of the hydrogen atoms attached to the nitrogen atom of the ammonia, amine or amide with the active chlorine atom. Surprisingly, the N-chloro-amide or amine is oil soluble and therefore when contacted with the flushing fluid will dissolve therein to oxidize the oil soluble unsaturated fats, carotene and bilirubin contained in the human waste product thereby preventing the flushing fluid from turning yellow.

In general, the reaction between the water-soluble chlorine compound and the amide or amine contained in human waste products can be exemplified as follows:

$$R{-}NH_2 + R'{-}Cl \rightarrow (R)_p{-}N(H)_n(Cl)_m + R'H$$

wherein R is any organic radical or hydrogen and R′ is an inorganic radical, $n$ is an integer of from 0 to 1, $p$ is an integer of from 0 to 1, $m$ is an integer of from 1 to 3, and the sum of $p + m + n$ is 3.

If the amide or amine contained in the waste product is urea and the water-soluble chlorine compound is sodium hypochlorite the reaction would be as floows:

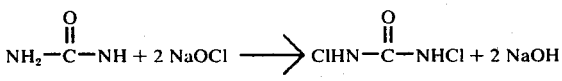

It appears that the oil soluble amine fomred in situ which is most desirable is trichloro amine which is formed by the reaction of ammonia with the water soluble compound containing an active chlorine atom (e.g. the hypochlorite ion or chlorite ion). The reaction would be as follows:

$$NH_3 + {}_{X}{}^{+} + {}_{OCl}{}^{-} \rightarrow {}_{NH2}Cl + NHCl_2 + NCl_3 + OX_2$$

Neither $NHCl_2$ nor $NH_2Cl$ are oil soluble and therefore do not aid in preventing the oil from turning yellow.

The ammonia is formed from the urine by decomposition. It should be noted that the foregoing reaction is not only beneficial in forming $NCl_3$ but, since ammonia has a disagreeable odor, removing the ammonia prevents one of the noxious odors associated with toilets.

The N-chloro-amide or amine formed in the foregoing reactions, when contacted with the flushing oil, will be dissolved therein and the N-chloro-amide or amine will oxidize the oil soluble fats, carotene and bilirubin contained in the human waste products thereby preventing the flushing oil from becoming discolored. Moreover, it will also prevent the oil from having a noxious odor.

One of the reasons it is desirable to form the N-chloro-amide or amine in situ is because N-chloro-amide is substantially formed as needed. This is due to the fact that the water necessary to dissolve the water-soluble chlorine compound is derived from the human waste itself and there is a relationship between the amount of water and the amount of oil soluble saturated fats contained in the human waste. Thus, it can be seen, that the amount of water-soluble chlorine compound in the toilet is not critical providing, of course, that there is a sufficient amount to form the necessary chloro-amide or chloro-amine to oxidize the compounds causing the oil to turn yellow.

Since one of the purposes of the N-chloro-amide or amine is to oxidize the oil soluble saturated fats, carotene and bilirubin contained in human waste, the water immiscible flushing oil should be substantially unsaturated in order to prevent waste of the N-chloro-amide or amine. Exemplary of such water immiscible substantially unsaturated oils are those oils derived from petroleum such as mineral oil. It is of no particular moment what the density of the oil is (i.e. lower or higher than water) because in any event the oil can be separated from the human waste products providing it is water immiscible and has a different density or specific gravity than water. It is also generally preferably if the oil is not toxic or inflamable.

The particular amount of flushing oil, relative to the amount of human waste, is also not cirtical providing, of course, that there is a sufficient amount of oil to flush the human wastes to the separating or holding tank. Generally, from 10 to 30 grams of flushing oil will be sufficient.

The water-soluble chlorine compound containing an active chloro atom may be a variety of compounds such as triazine, for example, trichloro-s-triazinetrione, providing that the compound is water-soluble and is oil soluble. It is generally preferred if the compound, upon being dissolved in water, forms the ion, $OCl^-$, such compounds may have the general formula: X—OCl wherein X can be any cation such as an alkali metal, an alkaline earth metal, ammonia, etc. Exemplary of such compounds are sodium hypochlorite, potassium hypochlorite, ammonia perchlorate, sodium chlorate, calcium hyopchlorite, and various iscoyanurates such as sodium dichloroisocyanurate.

The water-soluble chlorine compound may be in the form of a solid, integral block (e.g. one pound block) which is placed so that when the toilet is flushed the human waste contained therein will contact the solid water-soluble chlorine compound and dissolve a sufficient amount thereof to react with the amides and amines contained in the human waste product and thus form a sufficient amount of the N-chloro-amide or amine to oxidize the oil soluble saturated fats, carotene and bilirubin contained in the human waste which have been dissolved in the flushing oil. Generally, a one pound block will last at least three months when in heavy use.

Another way of using the present invention is to dissolve the water-soluble chlorine compound in water and inject the thus obtained solution into the oils each time the toilet is flushed. Generally speaking, for normal use, about four to five grams of the water-soluble chlorine compound (e.g. sodium hypochlorite) has been found to be satisfactory and this can be accomplished by dissolving the water-soluble chlorine compound in water in a sufficient amount to produce a 12% solution and injecting approximately 40 milliters of the solution with each flush.

Whether the water-soluble compound is used as a solution, powdered form, gas form or solid form, the results are satisfactory in that the flushing fluid remains odor and bacteria free and, most importantly, is not contaminated with the objectional yellow color.

In one exemplary embodiment, the present invention was used in outdoor toilets wherein 40 milliters of a 12% aqueous solution of sodium hypochlorite was injected into the toilet each time it was flushed. The amount of oil plus the amount of sodium hypochlorite solution was such that there were about 3 quarts of liquid per flush. This toilet was used for over 3 months and, during that period of time, the system remained free of odors and the mineral oil (which was initially colorless) remained color free for that period of time.

In another exemplary embodiment a 1 pound block of sodium hypochlorite was used together with 10 gallons of mineral oil which also contained a blue dye. In this regard, we have found the color blue to be aesthetically pleasing to most people. At each flush the oil was recirculated and carried the human waste product in contact with the one pound block of sodium hypochlorite. This toilet was in use for 3 months before the sodium hypochlorite was exhausted and, during that period of time, the oil did not turn a yellow color but remained a pleasing blue color and, additionally, had no odor.

In the foregoing description certain concentrations, compounds, and oils have been exemplified; however, it is to be understood that such description was for the purpose of exemplification and is not to be considered limiting.

We claim:

1. A method for preventing the flushing oil contained in a recirclating toilet from becoming discolored with an offensive yellow color and having an offensive odor when contacted with animal waste products containing water, amides, amines, ammonia, oil soluble unsaturated fats, carotene and bilirubin, comprising removing said animal waste product from a toilet by flushing said animal waste products with a substantially saturated flushing oil which has a specific gravity different than that of water and bringing said animal waste product containing water, oil soluble unsaturated fats, carotene, bilirubin, amines, amides and ammonia into contact with a water-soluble chlorine compound having an active chlorine atom whereby said chlorine compound is dissolved in said water and react with said amine or amide to form an oil soluble N-chloro-amide or amine, and contacting said N-chloro-amide or amine with said flushing oil thereby dissolving said N-chloro-amide or amine in said flushing oil to contact said oil soluble unsaturated fats, carotene and bilirubin and oxidizing said fats, carotent and bilirubin thereby preventing said oils from becoming discolored.

2. A method according to claim 1 wherein the water-soluble chlorine compound forms $OCl^-$ when dissolved in water.

3. A method according to claim 1 wherein $NCl_3$ is the N-chloro-amine compound formed.

4. A method according to claim 1 wherein the water-soluble chlorine compound has the formula X—OCl, wherein X is a cation.

5. A method according to claim 4 wherein X is a member selected from the group consisting of an alkali metal, an alkaline earth metal and ammonia.

6. A method according to claim 1 wherein the flushing oil has a specific gravity less than 1.

7. A method according to claim 1 wherein the water-soluble chlorine compound is a chloro substitute triazine.

8. A method according to claim 1 wherein the water-soluble chlorine compound is trichloro-s-triazinetrione.

* * * * *